US010683713B2

(12) United States Patent
Oser

(10) Patent No.: US 10,683,713 B2
(45) Date of Patent: Jun. 16, 2020

(54) MULTI-MODE HYDRAULIC CYLINDER CONTROL SYSTEM FOR HYDRAULIC WORKOVER UNIT

(71) Applicant: HALLIBURTON ENERGY SERVICES, INC., Houston, TX (US)

(72) Inventor: Michael Stephen Oser, Frisco, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 15/779,253

(22) PCT Filed: Feb. 1, 2016

(86) PCT No.: PCT/US2016/015884
§ 371 (c)(1),
(2) Date: May 25, 2018

(87) PCT Pub. No.: WO2017/135919
PCT Pub. Date: Aug. 10, 2017

(65) Prior Publication Data

US 2018/0347293 A1 Dec. 6, 2018

(51) Int. Cl.
*F15B 11/17* (2006.01)
*E21B 19/086* (2006.01)
(Continued)

(52) U.S. Cl.
CPC ..... *E21B 19/086* (2013.01); *E21B 15/00* (2013.01); *E21B 44/00* (2013.01); *F15B 11/17* (2013.01);
(Continued)

(58) Field of Classification Search
CPC ..... F15B 11/024; F15B 21/14; F15B 2211/3058; F15B 2211/7741
See application file for complete search history.

(56) References Cited

U.S. PATENT DOCUMENTS 3,916,767 A * 11/1975 Barton ..... E02F 9/2239 91/516
4,216,702 A 8/1980 Brundidge et al.
(Continued)

OTHER PUBLICATIONS

Search Report; Netherlands Application No. 1042220; dated Sep. 6, 2017.
(Continued)

*Primary Examiner* — Michael Leslie
(74) *Attorney, Agent, or Firm* — Polsinelli PC

(57) ABSTRACT

Hydraulic workover system having at least two sets of hydraulic cylinders coupled with a single load. A plurality of control valves transitionable between a closed position and an open position, the plurality of control valves having at least one extend control valve disposed between each set of hydraulic cylinders and an extend supply pump, at least one retract control valve disposed between each set of hydraulic cylinders and a retract supply pump, and at least one float control valve disposed between each set of hydraulic cylinders and a float supply pump. A logic control system coupled with the plurality of control valves and configured to transition the plurality of control valves between the closed and open position, thereby controlling flow between the at least two sets of hydraulic cylinders and the extend supply pump, retract supply pump, and float supply pump.

22 Claims, 3 Drawing Sheets

(51) Int. Cl.

| | |
|---|---|
| ***E21B 44/00*** | (2006.01) |
| ***E21B 15/00*** | (2006.01) |
| ***F15B 21/02*** | (2006.01) |
| ***F15B 21/08*** | (2006.01) |
| ***F15B 21/14*** | (2006.01) |

(52) U.S. Cl.
CPC ..... *F15B 21/02* (2013.01); *F15B 21/082* (2013.01); *F15B 21/14* (2013.01); *F15B 2211/20576* (2013.01); *F15B 2211/6654* (2013.01); *F15B 2211/7053* (2013.01); *F15B 2211/7107* (2013.01); *F15B 2211/7741* (2013.01)

(56) References Cited

U.S. PATENT DOCUMENTS

| | | | | |
|---|---|---|---|---|
| 4,523,886 | A * | 6/1985 | Reeves | F15B 21/087 91/521 |
| 4,928,488 | A | 5/1990 | Hunger | |
| 6,094,910 | A | 8/2000 | Vatne | |
| 6,467,264 | B1 * | 10/2002 | Stephenson | F15B 11/006 60/484 |
| 6,688,393 | B2 * | 2/2004 | Sredensek | E21B 19/02 166/377 |
| 7,918,285 | B1 | 4/2011 | Graham et al. | |
| 9,133,669 | B1 | 9/2015 | Streety et al. | |
| 2002/0000157 | A1 | 1/2002 | Spratt | |
| 2004/0262015 | A1 | 12/2004 | Mazzella et al. | |
| 2005/0044849 | A1 | 3/2005 | Berthod et al. | |
| 2006/0283321 | A1 | 12/2006 | Bair | |
| 2009/0308692 | A1 | 12/2009 | Sattelberger et al. | |

OTHER PUBLICATIONS

International Search Report and Written Opinion; PCT Application No. PCT/US2016/015884; dated Oct. 12, 2016.

* cited by examiner

MULTI-MODE HYDRAULIC CYLINDER CONTROL SYSTEM FOR HYDRAULIC WORKOVER UNIT

CROSS-REFERENCE TO RELATED APPLICATIONS

This application is a national stage entry of PCT/US2016/015884 filed Feb. 1, 2016, said application is expressly incorporated herein in its entirety.

FIELD

The subject matter herein generally relates to a hydraulic workover unit and method of using the same, and in particular, a multi-mode hydraulic cylinder control system for a hydraulic workover unit.

BACKGROUND

Hydraulic workover units allow for movement of a load by actuating two sets of hydraulic cylinders between an extended and retracted position. Hydraulic workover units have operating modes that can be changed by manually operating valves adjacent to the hydraulic workover unit. Manual operation of valves and/or blocking of ports is a tedious and time consuming process, and prevents real-time control of the hydraulic workover unit.

DETAILED DESCRIPTION

Figure 1:
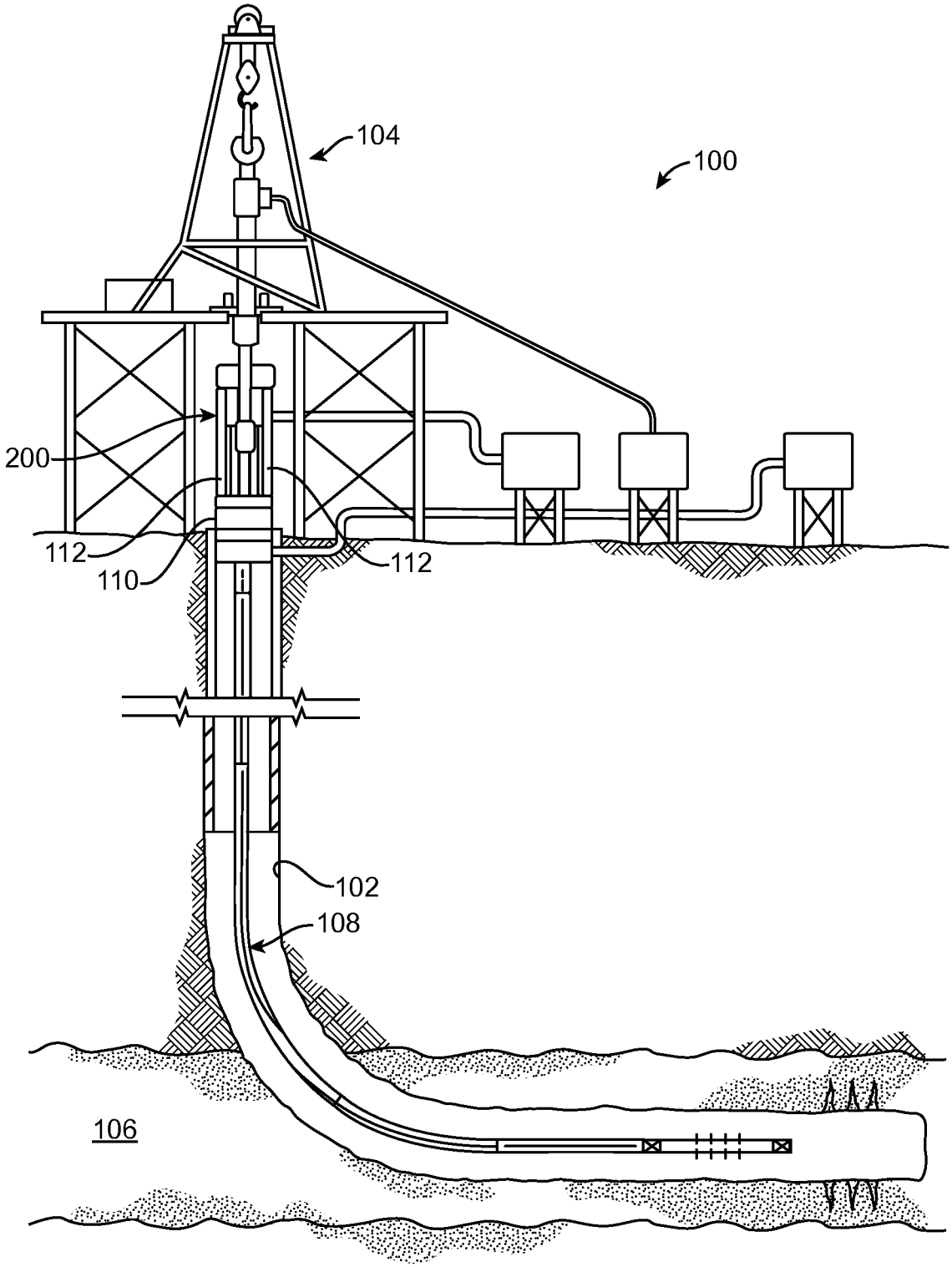
FIG. 1 illustrates a diagrammatic view of an example embodiment of a multi-mode hydraulic cylinder hydraulic workover unit.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

In the following description, terms such as "upper," "upward," "lower," "downward," "above," "below," "downhole," "uphole," "longitudinal," "lateral," and the like, as used herein, shall mean in relation to the bottom or furthest extent of the surrounding wellbore even though the wellbore or portions of it may be deviated or horizontal. Correspondingly, the transverse, axial, lateral, longitudinal, radial, etc., orientations shall mean orientations relative to the orientation of the wellbore or tool. Unless otherwise specified, any use of any form of the term "couple," or any other term describing an interaction between elements is not meant to limit the interaction to direct interaction between the elements and also may include indirect interaction between the elements described.

The term "inside" indicate that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder.

Disclosed herein is a multi-mode control system for a hydraulic workover system that employs multiple hydraulic cylinders to provide force and motion. The hydraulic workover system includes at least two sets of hydraulic cylinders coupled with a single load and transitionable between an extended position and a retracted position. Each set of hydraulic cylinders has an extension port and a retraction port.

An extend supply pump can be coupled with the extension port to provide hydraulic fluid to extend at least one set of hydraulic cylinders. A retract supply pump can be coupled with the retraction port to provide hydraulic fluid to retract at least one set of hydraulic cylinders. A float supply pump coupled with the extension port and the retraction port to provide hydraulic fluid to lubricate at least one set of hydraulic cylinders. In at least one embodiment, the retract supply pump and extend supply pump can be combined with a switching valve.

The hydraulic workover system can also include a plurality of control valves and a logic control system. Each of the control valves is transitionable between a closed position and an open position. The plurality of control valves having at least one extend control valve disposed between each set of hydraulic cylinders and the extend supply pump, at least one retract control valve disposed between each set of hydraulic cylinders and the retract supply pump, and at least one float control valve disposed between each set of hydraulic cylinders and the float supply pump. A logic control system coupled with the plurality of control valves and configured to transition the plurality of control valves between the closed position and the open position. The logic control system controls flow between the at least two sets of hydraulic cylinders and the extend supply pump, retract supply pump, and float supply pump.

The plurality of control valves can include a regeneration control valve disposed between the extend control valve, retract control valve, and float supply valve. The regeneration control valve allows hydraulic fluid to flow directly from the extension port to the retraction port, or vice versa, without returning to a pump, thereby improving performance of the hydraulic workover system.

The logic control system controls the hydraulic workover system to switch between a plurality of operating modes. Each operating mode transitions one or more of the plurality of control valves to a predetermined position. The operating modes can include, but are not limited to, a park mode, a purge mode, a warming mode, a regeneration mode, a high speed mode, a low speed mode, and/or combinations thereof.

The park mode is defined as each of the plurality of control valves in a closed position and the at least two sets of hydraulic cylinders are hydraulically locked, thus preventing movement of the load.

The purge mode/warming mode is defined by the plurality of control valves being in the closed position and hydraulic fluid is circulated from the extend and retract supply pump to the counterbalance valves and back to tank, thereby warming the hydraulic fluid and purging any contaminates from the hydraulic workover system.

The high speed mode is defined by the float supply control valve coupled with one set of hydraulic cylinders in the open position allowing a float supply of hydraulic fluid flow, and the extend control valve and retract control valves coupled with the other set of hydraulic cylinders are open allowing a substantial majority of hydraulic fluid flow, thus allowing the load to move a substantially double a normal operation speed. In an embodiment having two sets of hydraulic cylinders, the high speed mode moves the load with twice as fast as the normal operation speed with half the force output. In an embodiment having three sets of hydraulic cylinders, the high speed mode moves the load three times as fast as the normal operation speed with a third of the force output.

The low speed mode is defined by the extend control valve and retract control valve coupled with each set of hydraulic cylinders are open and allow hydraulic fluid flow from the extend supply pump and the retract supply pump, thereby moving the load at a normal operation speed. For example, when provided with two sets of hydraulic cylinders, the normal operation speed moves the load with twice the force of the high speed mode.

The regeneration mode is defined by the regeneration control valve being in the open position. The regeneration mode can be implemented in combination with the high speed or low speed modes, but can only be implemented to extend the cylinders. When in regeneration mode, the hydraulic workover system automatically engages regeneration during extension of the hydraulic cylinder and disengages during retraction.

While the present disclosure is described in relation to a hydraulic workover unit utilizing hydraulic cylinders, the present disclosure can be implemented with any hydraulic actuator, motor, or cylinder configured to transition a load from one position to another, or an electric motor or electric actuator. While two sets of hydraulic cylinders are shown in relation to the illustrated embodiment, more than two sets of hydraulic cylinders, for example four sets of hydraulic cylinders can be implemented without deviating from the present disclosure.

The present disclosure is described with respect to a plurality of pilot pressure controlled valves; however, it is within the scope of this disclosure to implement electrical signals operating solenoid operated control valves. In some instances, the electrical signals operating solenoid operated control valves can be computer controlled (having a processor) and include software driven logic.

FIG. 1 illustrates a well site 100 having a multi-mode hydraulic cylinder hydraulic workover unit 200 in accordance with an example embodiment. The well site 100 has a wellbore 102 formed in the subterranean formation 106. The well site 100 can include a rig 104 disposed above the wellbore 102. The rig 104 can have one or more safety devices 110, such as a blowout preventer, disposed below the hydraulic workover unit 200.

The hydraulic workover unit 200 can be coupled with a load 108 to be disposed within the wellbore 102. The load 108 can be a drill pipe, drill string, or downhole tool to be disposed within a wellbore 102. The hydraulic workover unit 200 can employ force and motion to move the load 108 into the wellbore 102. As the load extends into the wellbore 102, the required force to dispose the load 108 further into the wellbore 102 typically increases. The hydraulic workover unit 200 can have multiple operating modes to efficiently move the load 108 within the wellbore 102.

The hydraulic workover unit 200 can include two or more sets of hydraulic cylinders 112 disposed around the load 108 to force the load 108 into or out of the wellbore 102. The sets of hydraulic cylinders 112 can be diagonally disposed on opposing sides of the load 108, such that each set of hydraulic cylinders 112 even applies force to the load 108. This arrangement allows each set of hydraulic cylinders 112 to apply force on the load individually in a perfectly vertical manner.

Each set of hydraulic cylinders 112 can be configured to apply a predetermined amount of force to the load 108 upon actuation. The hydraulic workover unit 200 can have a load capacity split evenly among each set of cylinders 112. The hydraulic cylinders 112 can be actuated by hydraulic fluid or oil to move the load. The hydraulic workover unit 200 can supply the hydraulic fluid to evenly each set of hydraulic cylinders 112 to provide full load capacity or provide all the hydraulic fluid to a single set of hydraulic cylinders 112 to provide half load capacity, but doubled speed.

During low load force requirements, the hydraulic workover unit 200 can employ a single set of hydraulic cylinders 112 at half load capacity with double the strokes per minute. During high load force requirements, the hydraulic workover unit 200 can employ both sets of hydraulic cylinders 112 at full load capacity.

While the present embodiment is shown and described with respect to land based operations, the present embodiment can also be implemented in sea based operations.

Figure 2:
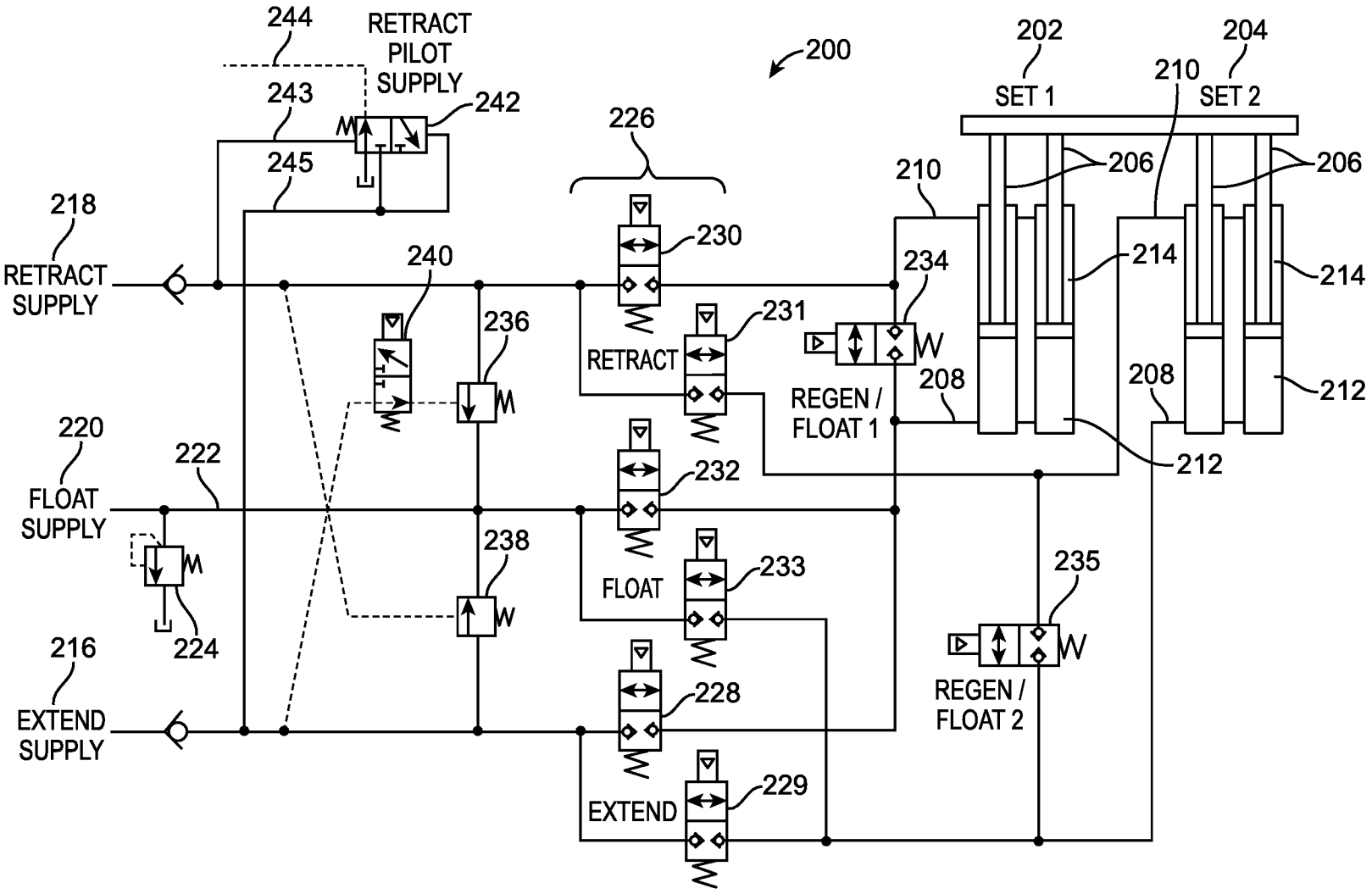
FIG. 2 is a diagrammatic view a multi-mode control system of a hydraulic workover unit.

FIG. 2 illustrates a diagrammatic view of the multi-mode hydraulic work unit 200. The hydraulic workover unit 200 has at least two sets of hydraulic cylinders 202, 204 coupled with a single load and transitionable between an extended position and a retracted position. The sets of hydraulic cylinders 202, 204 can have a rod and piston 206 disposed therein. The piston 206 separates the hydraulic cylinder 202, 204 into a rod side 214 and a blind side 212.

Each set of hydraulic cylinders 202, 204 has an extension port 208 and a retraction port 210. Each extension port 208 is fluidly coupled with each respective set of hydraulic cylinders 202, 204 and receives fluid into the blind side 212 of the hydraulic cylinder 202, 204, thereby extending the piston 206 to the extended position. The extension port 208 can also expel fluid from the blind side 212 when transitioning the piston 206 from the extended position to the retracted position.

Each retraction port 210 is fluidly coupled with each respective set of hydraulic cylinders 202, 204 and receives fluid into the rod side 214 of the hydraulic cylinders 202, 204, thereby retracting the hydraulic cylinders 202, 204 to the retracted position. The retraction port 210 can also expel fluid from the rod side 214 when transitioning the piston 206 from the retracted position to the extended position.

The hydraulic cylinders 202, 204 can be coupled to a extend supply pump 216 and a retract supply pump 218. The extend supply pump 216 is fluidly coupled with the extension port 208 to provide hydraulic fluid to the blind side 212 of the hydraulic cylinder 202, 204, thereby extending the piston 206 and transitioning the hydraulic cylinder 202, 204 to the extended position.

The retract supply pump 218 is fluidly coupled with the retraction port 210 to provide hydraulic fluid to the rod side 214 of the hydraulic cylinder 202, 204, thereby retracting the piston 206 and transitioning the hydraulic cylinder 202, 204 to the retracted position.

The hydraulic workover unit 200 can also include a float supply pump 220 fluidly coupled with the extension port 208 and the retraction port 210. The float supply pump 220 can provide hydraulic fluid to lubricate the hydraulic cylinder 202, 204. The float supply pump 220 can be coupled to the extension port 208 and the retraction port 210 via a float supply line 222. The float supply line 222 can also be coupled to a tank 224 configured to receive hydraulic fluid flowing away from the hydraulic cylinder 202, 204. The float supply line 222 can be bi-directional allowing fluid flow from the float supply pump 220 in one direction, and fluid flow to the tank 224 in an opposite direction.

The hydraulic workover unit 200 has a plurality of control valves 226 transitionable between a closed position and an open position. The plurality of control valves 226 includes two extend control valves 228, 229, two retract control valves 230, 231, and two float supply valves 232, 233. Each of the plurality of control valves 226 can be spring biased to the closed position. In the closed position, the control valves 226 prevent fluid flow therethrough. In the open position, the control valves 226 allow fluid to flow therethrough. The plurality of control valves 226 are positive seal, zero leak valves.

The extend control valves 228, 229 are coupled with the extension port 208 and the extend supply pump 216. The extend control valves 228, 229 are configured to control hydraulic fluid flow between the extend supply pump 216 and each set of hydraulic cylinders 202, 204. Each of the two extend control valves 228, 229 can be transitioned between the closed position and open position independent of the other. One extend control valve 228 can be coupled with hydraulic cylinder set 202 and the other extend control valve 229 can be coupled with hydraulic cylinder set 204.

In the closed position, the extend control valves 228 prevent fluid flow from and between the extend supply pump 216 and the extension port 208. In the open position, the extend control valves 228 allow fluid flow from the extend supply pump 216 to the extension port 208, thereby allowing fluid flow to the blind side 212 of the hydraulic cylinders 202, 204.

The retract control valves 230, 231 are coupled with the retract port 210 and the retract supply pump 218. The retract control valves 230, 231 are configured to control hydraulic fluid flow between the retract supply pump 218 and each set of hydraulic cylinders 202, 204. Each of the two retract control valves 230, 231 can be transitioned between the closed position and the open position independent of the other. One retract control valve 230 can be coupled with hydraulic cylinder set 202 and the other retract control valve 231 can be coupled with hydraulic cylinder set 204.

In the closed position, the retract control valves 230 prevent fluid flow from and between the retract supply pump 218 and the retraction port 210. In the open position, the retract control valves 230 allow fluid flow from the retract supply pump 218 to the retraction port 210, thereby allowing fluid flow to the rod side 214 of the hydraulic cylinders 202, 204.

The float supply control valves 232, 233 are coupled with the extension port 208, retraction port 210, and the float supply pump 220. The float supply valves 232, 233 are configured to control hydraulic fluid between the float supply pump 220 and each set of hydraulic cylinders 202, 204. Each of the two float supply control valves 232, 233 can be transitioned between the closed position and the open position independent of the other. One float supply control valve 232 can be coupled with hydraulic cylinder set 202 and the other float supply control valve 233 can be coupled with hydraulic cylinder set 204.

In the closed position, the float supply control valves 232, 233 prevent fluid flow from and between the float supply pump 220, the extension port 208 and the retraction port 210. In the open position, the float supply control valves 232, 233 allow fluid flow from the float supply pump 220 to the extension portion 208 and the retraction port 210, thereby allowing fluid flow to the hydraulic cylinder sets 202, 204.

The plurality of control valves 226 can also include two regeneration control valves 234, 235. Regeneration control valves 234,235 can allow regeneration within each set of hydraulic cylinders 202, 204 increasing speed of the hydraulic workover unit 200.

The transition of the plurality of control valves 226 allows the hydraulic workover unit 200 to have multiple operating modes. The operating modes can include a low speed, a high speed set 1, a high speed set 2, an automatic regeneration mode, a park mode, and purge/warming mode.

Low speed allows operation of both sets of hydraulic cylinders 202, 204 simultaneously and maximizing force of the hydraulic workover unit 200. Each of set of hydraulic cylinders 202, 204 extends and retracts as fluid flow is received by the extension port 208 and retraction port 210. The extend control valves 228, 229 retract control valves 230, 231 are all set to the open position and float supply control valves 232, 233 are set to the closed position. The retract 230, 231 and extend 228, 229 control valves being in the open position allows hydraulic fluid flow from the extend supply pump 216 to the blind side 212 of each hydraulic cylinder 202, 204 and from the retract supply pump 218 to the rod side 214 of each hydraulic cylinder 202, 204. As the hydraulic cylinders 202, 204 actuate between the extended position and retracted position, the hydraulic fluid is expelled through the respective extension port 208 or retraction port 210, through the retract 230, 231 or extend 228, 229 control valves to tank 224 via respective counterbalance valves 236, 238. For example, low speed can allow movement of the hydraulic cylinder sets 202, 204 at 400,000 lbs at 6 strokes per minute.

High speed allows a single set of hydraulic cylinders 202, 204 to act on the load while the other set of hydraulic cylinders 202, 204 remains floated and inactive. Floated cylinders are still provided with fluid in such a way to provide continuous lubrication to the cylinders and prevent cavitation. Inactive cylinders are not hydraulically coupled to the load, and therefore not supplying a force to move the load. For example, high speed can allow movement of the one of the hydraulic cylinder sets 202, 204 at 200,000 lbs at 12 strokes per minute.

High speed set 1 implements the set of hydraulic cylinders 202 to carry the load while the cylinders 204 are floated and inactive. The use of hydraulic cylinders 202 to carry the load allows maximum operating speed while only providing power to move the load from a single set of hydraulic cylinders. Extend control valve 228 is open while extend control valve 229 is closed and retract control valve 230 is open while retract control valve 231 is closed, thereby allowing hydraulic cylinders 202 to carry the load.

Float supply valve 233 and regeneration supply valve 235 are open to provide float charge pressure to hydraulic cylinder set 204 and open the blind side 212 and rod side 214 to the float charge pressure via the extension port 208 and retraction port 210 respectively.

Similarly, high speed set 2 implements the set of hydraulic cylinders 204 to carry the load while the cylinders 202 are floated and inactive. The use of hydraulic cylinders 204 to carry the load allows maximum operating speed while only proving power to move the load from a single set of hydraulic cylinders. Extend control valve 229 is open while extend control valve 228 is closed and retract control valve 231 is open while retract control valve 230 is closed, thereby allowing hydraulic cylinders 204 to carry the load.

Float supply valve 232 and regeneration supply valve 234 are open to provide float charge pressure to hydraulic cylinder set 202 and open the blind side 212 and rod side 214 to the float charge pressure via the extension port 208 and retraction port 210 respectively.

In high speed sets 1 and 2, the hydraulic workover unit 200 can function at maximum operating speed and half of its maximum load capacity.

Low speed regeneration operates substantially similar to low speed having both sets of cylinders 202, 204 active and functioning to move the load, but with regeneration valves 234, 235 open. The rod side 214 of all cylinders is open to the blind side 212 as allowing fluid to flow out of the rod side 214 and into the blind side 212 as the rod and piston 206 extends. The increased fluid flow from the rod side 214 increases the speed of the cylinder for a given primary hydraulic flow rate. The increased speed is a caused by the difference in effective areas between the rod 214 and blind side 212 of the cylinders, thus the total available force is reduced in proportion to the ratio of areas. Regeneration is only available with hydraulic cylinders with different rod side 214 and blind side 212 areas and is only available during extension of the sets of cylinders 202, 204.

High speed set 1 and high speed set 2 can each also be implemented with regeneration. In high speed set 1, float supply valve 234 is open to allow regeneration for set of hydraulic cylinders 202. In high speed set 2, float supply valve 235 is open to allow regeneration for set of hydraulic cylinders 204. Regeneration for high speed set 1 and high speed set 2 function substantially similar to low speed regeneration, except that one set of hydraulic cylinders 202, 204 is floated and inactive.

Automatic regeneration can be implemented with any of the low speed regeneration, high speed set 1 regeneration, or high speed set 2 regeneration modes. Automatic regeneration can engage regeneration while the cylinders are extended and disengage regeneration while the cylinders are retracted. Automatic regeneration can be provided by retract pilot supply valve 242 and associated supply lines 243 and 245. Supply line 243 is connected to the retract side of the hydraulic workover unit 200 and supply line 245 is coupled to the extend side of the hydraulic workover unit 200. Retract pilot supply valve 242 provides the source pilot pressure from the regeneration activation controls and is normally set to block pilot pressure from passing through the valve and onto the regeneration controls. When a regeneration mode is engaged, hydraulic power is supplied from the extend supply pump 216 to the extend the cylinders pilot line 245 actuating pilot supply valve 242 against the spring and allowing pressure from supply line 245 through the valve to activate at least one of regeneration control valves 234, 235 depending on which set of cylinders 202, 204 is active or both if both sets of cylinders 202, 204 are active. When hydraulic power is supplied from the retract supply pump 218, the supply line 243 provides pressure to shift the pilot supply valve 242 to block pilot pressure to regeneration control valves 234, 235, thus closing the regeneration control valves 235, 235 and deactivating the regeneration. The spring in the retract supply valve 242 reduces possible chattering by requiring positive pressure on the cylinder extend side before engaging regeneration. The retract CB disable valve 240 is also closed during regeneration to force fluid to move from the cylinder retract port 210 to the cylinder extend port 208 without escaping through counterbalance valve 236.

The hydraulic workover unit 200 can be in park mode when the plurality of control valves 226 are closed blocking all hydraulic pressure and flow from reaching the cylinders 202, 204. Each set of hydraulic cylinders 202, 204 is hydraulically locked and cannot move unless one of the plurality of control valves 226 is leaking. Any hydraulic fluid pressure supplied by the extend supply up 216 or retract supply pump 218 is blocked by the plurality of control valves 226. If the pressure exceeds a predetermined value, the hydraulic fluid will flow through counter balance valves 236, 238 and return to tank 224. Park mode can be activated manually, or through a coupling with another system that provides the necessary pilot signals to stop the cylinders at any time. Over pressure relief valves, not shown but fluidly connected between the retract port 206 or extend port 210 to the tank 224, act to relieve any dynamically induce pressure caused by the cylinders 202, 204 being in motion at the time park mode is engaged.

Warming mode can be engaged any time the hydraulic workover unit 200 is in park mode. In warming mode, any fluid pressure exceeding a predetermined value flows through counter balance valves 236, 238 and back to tank 224. Overpressure allows circulation of fluid through most of the power and return lines to flush, and if filtered, clean the fluid without any chance of the cylinders moving. Filtering the flow of fluid through the hydraulic workover unit 200 can be useful after recent field connections exposing the hydraulic workover unit 200 connections to environmental conditions, such as dirt, sand, and other particulates. The warming mode in this operation can function as a purge mode to flush any possible contamination out of the lines and valves without passing the hydraulic fluid and contaminates through the plurality of control valves 226 or either set of hydraulic cylinders 202, 204.

Continued flow through the counter balance valves 236, 238 generates heat within the fluid depending on the amount of fluid flow and the pressure drop through the counter balance valves 236, 238. By controlling the flow rate and the predetermined pressure required to actuate the counter balance valves 236, 238, the heat rate can be controlled to a desired amount. Heating the fluid can be useful for starting the hydraulic workover unit 200 in cold environmental conditions.

Figure 3:
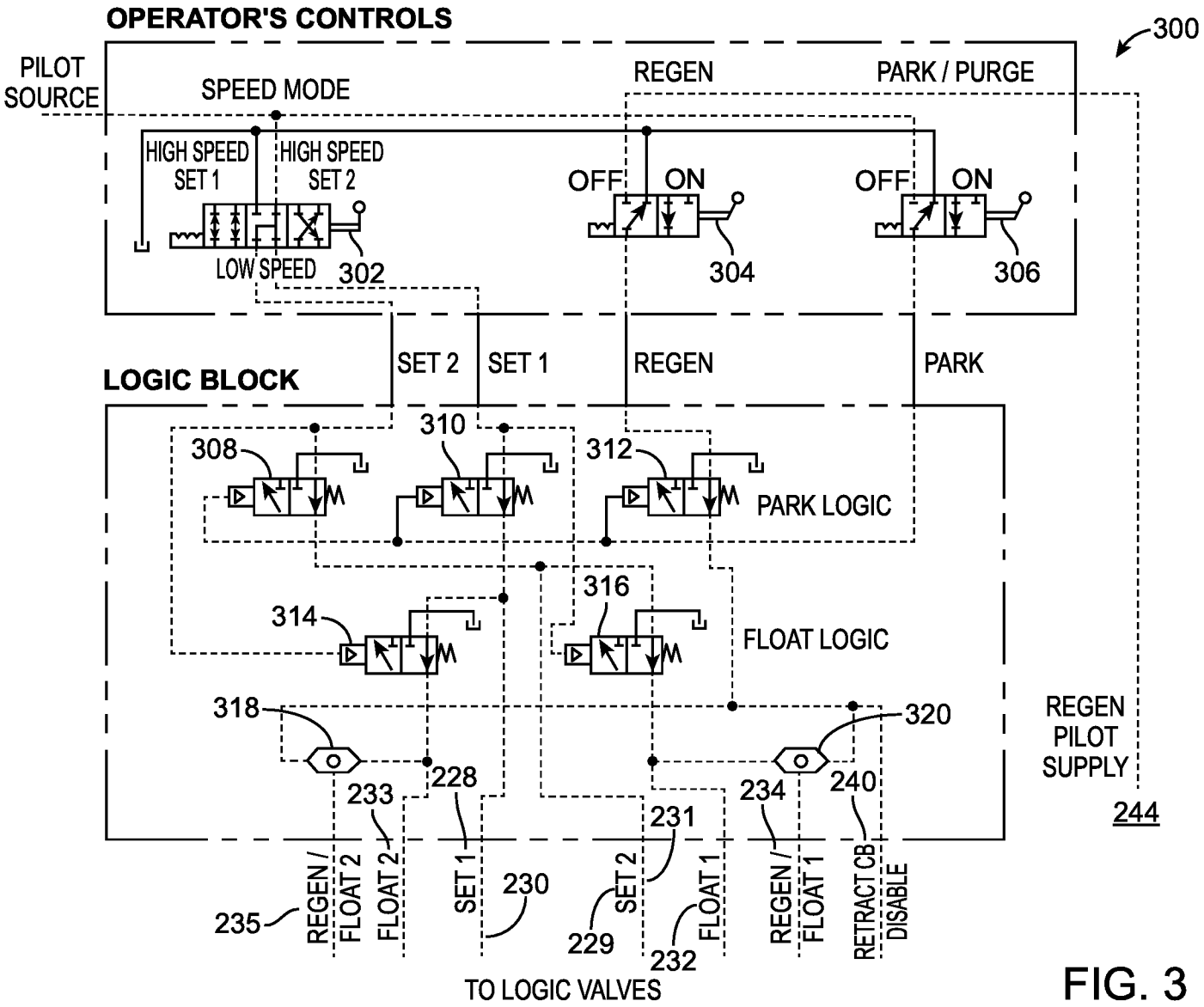
FIG. 3 is a diagrammatic view of a logic controller of a multi-mode control system for a hydraulic workover unit.

FIG. 3 illustrates an example control system 300 for a multi-mode hydraulic workover unit 200. The control system 300 can be coupled with the multi-mode hydraulic workover unit 200 and configured to actuate the plurality of control valves 226. The control system 300 includes three manual valves 302, 304, 306 for controlling the operating modes of the hydraulic workover unit 200. The cylinder set mode control valve 302 can transition the hydraulic workover unit 200 between low speed, high speed set 1, and high speed set 2. The cylinder set mode control valve 302 can be transitioned to engage either set of cylinders 202, 204 for high speed set 1 and high speed set 2, respectively, or engage both sets of cylinders 202, 204 for low speed mode.

As described above with respect to FIG. 2, the plurality of control valves 226 are biased to a closed position. A pilot pressure must be applied to signal each individual valve to transition from the closed position to the open position. The valves 226 being biased to a closed position acts as a failsafe, such that loss of control pressure causes the system to enter park mode where the cylinders are hydraulically locked and prevented from moving. The plurality of control valves 226 can also be biased to an open position if desired for a particular application.

Cylinder set mode control 302 in low speed mode allows pilot pressure to pass through park mode logic valves 308 and 310 to open extend control valves 228, 230 and retract control valves 229, 231. The pilot pressure also closes float mode logic valves 314, 316 to closed, thereby closing float control valves 232, 233. In this operating mode, all cylinders are active and carrying the load and float charge pressure is block by float valves 232, 233.

Cylinder set mode control 302 in high speed set 1 mode blocks and vents pilot pressure for cylinder set 204. Extend supply valve 231 and retract supply valve 229 are closed, thereby deactivating cylinder set 204. Pilot pressure passes through park mode logic valve 310 to open extend control valve 228 and retract supply valve 230. Pilot pressure also flows through float mode logic valve 314 to open float supply valve 233 and regeneration valve 235 to allow float charge pressure into hydraulic cylinder set 204. The pilot pressure also shifts float mode logic valve 316 to vent and close float supply valve 232 on hydraulic cylinder set 202.

Cylinder set mode control 302 in high speed set 2 mode blocks and vents pilot pressure for cylinder set 202. Extend supply valve 230 and retract supply valve 228 are closed, thereby deactivating cylinder set 202. Pilot pressure passes through park mode logic valve 308 to open extend control valve 229 and retract supply valve 231. Pilot pressure also flows through float mode logic valve 316 to open float supply valve 232 and regeneration valve 234 to allow float charge pressure into hydraulic cylinder set 202. The pilot pressure also shifts float mode logic valve 314 to vent and close float supply valve 233 on hydraulic cylinder set 204.

Regeneration mode control 304 is transitionable between on and off to control use of regeneration within the operating modes. When regeneration mode control 304 is on and the cylinders 206 are extended, pilot pressure 244, 245 from extend supply pump 216 passes through park mode logic valve 312 to shuttle valves 318 and 320 to open regeneration control valves 234, 235. Shuttle valves 318, 320 allow either float mode or regeneration mode to operate the regeneration valves 234, 235 to provide regeneration if the cylinder set is active and carrying the load, or to open both extend and retract sides of the cylinder to the float charge pressure if the set is inactive. During automatic regeneration as described above with respect to FIG. 2, the regeneration pilot source 244, 245 to the regeneration mode control 304 is interrupted by retract pilot supply 242 when the cylinder is retracted disabling regeneration even if regeneration mode control 304 is on.

Park mode control 306 is set on when pilot pressure shifts valves 308, 310, and 312 which vents pressure to retract control valves 228, 229, extend control valves, 230, 231, float supply valves 232, 233 and regeneration control valves 234, 235 logic valves, thereby closing each valve and isolating the cylinders from hydraulic power. The isolation from hydraulic power hydraulically locks each set of cylinders 202, 204 and prevents movement of the load and the rods and pistons 206.

It is believed the exemplary embodiment and its advantages will be understood from the foregoing description, and it will be apparent that various changes may be made thereto without departing from the spirit and scope of the disclosure or sacrificing all of its advantages, the examples hereinbefore described merely being preferred or exemplary embodiments of the disclosure.

Statements of the Disclosure Include:

Statement 1: A hydraulic workover system comprising at least two sets of hydraulic cylinders coupled with a single load and transitionable between an extended position and a retracted position, each set of hydraulic cylinders having an extension port and a retraction port, an extend supply pump fluidly coupled with the extension port, the extend supply pump providing hydraulic fluid to extend at least one set of the hydraulic cylinders to the extending position, a retract supply pump fluidly coupled with the retraction port, the retract supply pump providing hydraulic fluid to retract at least one set of the hydraulic cylinders to the retracted position, a float supply pump fluidly coupled with the extension port and the retraction port, the float supply pump providing hydraulic fluid to lubricate at least one set of the hydraulic cylinders, a plurality of control valves transitionable between a closed position and an open position, the plurality of control valves having at least one extend control valve disposed between each set of hydraulic cylinders and the extend supply pump, at least one retract control valve disposed between each set of hydraulic cylinders and the retract supply pump, and at least one float control valve disposed between each set of hydraulic cylinders and the float supply pump, and a logic control system communicatively coupled with the plurality of control valves and configured to transition the plurality of control valves between the closed position and the open position, thereby controlling flow between the at least two sets of hydraulic cylinders and the extend supply pump, retract supply pump, and float supply pump.

Statement 2: The hydraulic workover system of Statement 1, wherein the plurality of control valves includes a regeneration control valve disposed between the extend control valve, retract control valve, and float supply valve, the regeneration control valve allowing hydraulic fluid to flow.

Statement 3: The hydraulic workover system of any one of the preceeded Statements 1 or 2, further comprising a plurality of operating modes wherein the logic control system transitions the plurality of control valves in a predetermined sequence to transition between the plurality of modes.

Statement 4: The hydraulic workover system of Statement 3, wherein the plurality of operating modes includes a park mode, each of the plurality of control valves is closed in the park mode and the at least two sets of hydraulic cylinders are hydraulically locked, thus the load remains stationary.

Statement 5: The hydraulic workover system of Statement 3, wherein the plurality of operating modes includes a high speed mode wherein the float supply control valve coupled with one set of hydraulic cylinders is open allowing a float supply of hydraulic fluid flow and the extend control valve and retract control valve coupled with the one set of hydraulic cylinders are open allowing a substantial majority of hydraulic fluid flow, thus allowing the load to move at substantially double a normal operation speed.

Statement 6: The hydraulic workover system of Statement 3, wherein the plurality of operating modes includes a low speed mode wherein the extend control valve and retract control valve coupled with each set of hydraulic cylinders are open allowing hydraulic fluid flow from the extend supply pump and the retract supply pump, thereby moving the load at a normal operation speed.

Statement 7: The hydraulic workover system of Statement 3, wherein the plurality of operating modes includes a warming mode wherein the plurality of control valves are closed and hydraulic fluid is circulated from the extend and retract supply pump to the counterbalance valves, thereby warming the hydraulic fluid.

Statement 8: The hydraulic workover system of any one of the preceeding Statements 1-7, wherein the at least two sets of hydraulic cylinders is three sets of hydraulic cylinders attached to a single load and transitionable between the extended position and the retracted position.

Statement 9: The hydraulic workover system of any preceding Statements 1-8, wherein the at least two sets of hydraulic cylinders are configured to dispose pipe into a wellbore.

Statement 10: A hydraulic workover unit comprising at least two sets of hydraulic cylinders coupled with a single load and transitionable between an extended position and a retracted position, each set of hydraulic cylinders having an extension port configured to be coupled to an extend supply pump and a retraction port configured to be coupled with a retract supply pump, a plurality of control valves transitionable between a closed position and an open position, the plurality of control valves having at least one extend control valve, at least one retract control valve, and at least one float control valve, and a logic control system communicatively coupled with the plurality of control valves and configured to transition the plurality of control valves between the closed position and the open position, thereby controlling flow between the at least two sets of hydraulic cylinders and the extend supply pump, retract supply pump, and float supply pump.

Statement 11: The hydraulic workover unit of Statement 10, wherein the plurality of control valves includes a regeneration control valve disposed between the extend control valve, retract control valve, and float supply valve, the regeneration control valve allowing hydraulic fluid to flow.

Statement 12: The hydraulic workover unit of any one of the preceding Statements 10 or 11, further comprising a plurality of operating modes wherein the logic control system transitions the plurality of control valves in a predetermined sequence to transition between the plurality of modes.

Statement 13: The hydraulic workover unit of Statement 12, wherein the plurality of operating modes includes a park mode, each of the plurality of control valves is closed in the park mode and the at least two sets of hydraulic cylinders are hydraulically locked, thus the load remains stationary.

Statement 14: The hydraulic workover unit of Statement 12, wherein the plurality of operating modes includes a high speed mode wherein the float supply control valve coupled with one set of hydraulic cylinders is open allowing a float supply of hydraulic fluid flow and the extend control valve and retract control valve coupled with the one set of hydraulic cylinders are open allowing a substantial majority of hydraulic fluid flow, thus allowing the load to move at substantially double a normal operation speed.

Statement 15: The hydraulic workover unit of Statement 12, wherein the plurality of operating modes includes a low speed mode wherein the extend control valve and retract control valve coupled with each set of hydraulic cylinders are open allowing hydraulic fluid flow from the extend supply pump and the retract supply pump, thereby moving the load at a normal operation speed.

Statement 16: The hydraulic workover unit of any of the preceding Statements 10-15, wherein the plurality of operating modes includes a warming mode wherein the plurality of control valves are closed and hydraulic fluid is circulated from the extend and retract supply pump to the counterbalance valves, thereby warming the hydraulic fluid.

Statement 17: The hydraulic workover unit of any one of the preceding Statements 10-16, wherein the at least two sets of hydraulic cylinders is three sets of hydraulic cylinders attached to a single load and transitionable between the extended position and the retracted position.

Statement 18: A method for controlling a multi-mode hydraulic workover system comprising operating a multi-mode hydraulic workover unit coupled to a load transitionable between a plurality of operating modes, the multi-mode hydraulic work over unit comprising at least two sets of hydraulic cylinders transitionable between an extended position and a retracted position, a plurality of control valves transitionable between a closed position and an open position, the plurality of control valves having at least one extend control valve, at least one retract control valve, and at least one float control valve, and a logic control system communicatively coupled with the plurality of control valves and configured to transition the plurality of control valves between the closed position and the open position, and transitioning, by the logic control system, the multi-mode hydraulic workover unit from one operating mode to another by transitioning the one or more of the plurality of control between the open and close positions.

Statement 19: The method of Statement 18, wherein transitioning the multi-mode hydraulic workover unit from one operating mode to another includes transitioning from a park mode wherein each of the plurality of control valves is closed to a low speed mode wherein the at least extend control valve and the at least one retract control valve are transitioned to open.

Statement 20: The method of any one of the preceding Statements 18 or 19, wherein transitioning the multi-mode hydraulic workover unit from one operating mode to another includes transitioning to a high speed mode wherein the at least extend control valve and the at least one retract control valve are transitioned to open for one set of hydraulic cylinders and the at least extend control valve and the at least one retract control valve are closed for the other set of hydraulic cylinders.

Statement 21: The method of any one of the preceding Statements 18-20, wherein transitioning the multi-mode hydraulic workover unit from one operating mode to another includes engaging a regeneration mode wherein at least one regeneration control valve is open during extension of at least one of the set of hydraulic cylinders.

Statement 22: The method of any one of the preceding Statements 18-21, wherein the at least two sets of hydraulic cylinders are configured to dispose pipe into a wellbore.

What is claimed is:

1. A hydraulic workover system comprising:

at least two sets of hydraulic cylinders coupled with a single load and transitionable between an extended position and a retracted position, each set of hydraulic cylinders having an extension port and a retraction port;

an extend supply pump fluidly coupled with the extension port, the extend supply pump providing hydraulic fluid to extend at least one set of the hydraulic cylinders to the extending position;

a retract supply pump fluidly coupled with the retraction port, the retract supply pump providing hydraulic fluid to retract at least one set of the hydraulic cylinders to the retracted position;

a float supply pump fluidly coupled with the extension port and the retraction port, the float supply pump providing hydraulic fluid to lubricate at least one set of the hydraulic cylinders;

a plurality of control valves transitionable between a closed position and an open position, the plurality of control valves having at least one extend control valve disposed between each set of hydraulic cylinders and the extend supply pump, at least one retract control valve disposed between each set of hydraulic cylinders and the retract supply pump, and at least one float control valve disposed between each set of hydraulic cylinders and the float supply pump; and a logic control system communicatively coupled with the plurality of control valves and configured to transition the plurality of control valves between the closed position and the open position, thereby controlling flow between the at least two sets of hydraulic cylinders and the extend supply pump, retract supply pump, and float supply pump.

2. The hydraulic workover system of claim 1, wherein the plurality of control valves includes a regeneration control valve disposed between the extend control valve, retract control valve, and float control valve, the regeneration control valve allowing hydraulic fluid to flow.

3. The hydraulic workover system of claim 1, further comprising a plurality of operating modes wherein the logic control system transitions the plurality of control valves in a predetermined sequence to transition between the plurality of modes.

4. The hydraulic workover system of claim 3, wherein the plurality of operating modes includes a park mode, each of the plurality of control valves is closed in the park mode and the at least two sets of hydraulic cylinders are hydraulically locked, thus the load remains stationary.

5. The hydraulic workover system of claim 3, wherein the plurality of operating modes includes a high speed mode wherein the float supply control valve coupled with one set of hydraulic cylinders is open allowing a float supply of hydraulic fluid flow and the extend control valve and retract control valve coupled with the one set of hydraulic cylinders are open allowing a substantial majority of hydraulic fluid flow, thus allowing the load to move at substantially double a normal operation speed.

6. The hydraulic workover system of claim 3, wherein the plurality of operating modes includes a low speed mode wherein the extend control valve and retract control valve coupled with each set of hydraulic cylinders are open allowing hydraulic fluid flow from the extend supply pump and the retract supply pump, thereby moving the load at a normal operation speed.

7. The hydraulic workover system of claim 3, wherein the plurality of operating modes includes a warming mode wherein the plurality of control valves are closed and hydraulic fluid is circulated from the extend and retract supply pump to at least one counterbalance valves, thereby warming the hydraulic fluid.

8. The hydraulic workover system of claim 1, wherein the at least two sets of hydraulic cylinders is three sets of hydraulic cylinders attached to a single load and transitionable between the extended position and the retracted position.

9. The hydraulic workover system of claim 1, wherein the at least two sets of hydraulic cylinders are configured to dispose pipe into a wellbore.

10. A hydraulic workover unit comprising:

at least two sets of hydraulic cylinders coupled with a single load and transitionable between an extended position and a retracted position, each set of hydraulic cylinders having an extension port configured to be coupled to an extend supply pump and a retraction port configured to be coupled with a retract supply pump;

a plurality of control valves transitionable between a closed position and an open position, the plurality of control valves having at least one extend control valve, at least one retract control valve, and at least one float control valve; and a logic control system communicatively coupled with the plurality of control valves and configured to transition the plurality of control valves between the closed position and the open position, thereby controlling flow between the at least two sets of hydraulic cylinders and the extend supply pump, retract supply pump, and a float supply pump.

11. The hydraulic workover unit of claim 10, wherein the plurality of control valves includes a regeneration control valve disposed between the extend control valve, retract control valve, and float control valve, the regeneration control valve allowing hydraulic fluid to flow.

12. The hydraulic workover unit of claim 10, further comprising a plurality of operating modes wherein the logic control system transitions the plurality of control valves in a predetermined sequence to transition between the plurality of modes.

13. The hydraulic workover unit of claim 12, wherein the plurality of operating modes includes a park mode, each of the plurality of control valves is closed in the park mode and the at least two sets of hydraulic cylinders are hydraulically locked, thus the load remains stationary.

14. The hydraulic workover unit of claim 12, wherein the plurality of operating modes includes a high speed mode wherein the float supply control valve coupled with one set of hydraulic cylinders is open allowing a float supply of hydraulic fluid flow and the extend control valve and retract control valve coupled with the one set of hydraulic cylinders are open allowing a substantial majority of hydraulic fluid flow, thus allowing the load to move at substantially double a normal operation speed.

15. The hydraulic workover unit of claim 12, wherein the plurality of operating modes includes a low speed mode wherein the extend control valve and retract control valve coupled with each set of hydraulic cylinders are open allowing hydraulic fluid flow from the extend supply pump and the retract supply pump, thereby moving the load at a normal operation speed.

16. The hydraulic workover unit of claim 12, wherein the plurality of operating modes includes a warming mode wherein the plurality of control valves are closed and hydraulic fluid is circulated from the extend and retract supply pump to at least one counterbalance valves, thereby warming the hydraulic fluid.

17. The hydraulic workover unit of claim 10, wherein the at least two sets of hydraulic cylinders is three sets of hydraulic cylinders attached to a single load and transitionable between the extended position and the retracted position.

18. A method for controlling a multi-mode hydraulic workover system comprising:

operating a multi-mode hydraulic workover unit coupled to a load transitionable between a plurality of operating modes, the multi-mode hydraulic work over unit comprising: at least two sets of hydraulic cylinders transitionable between an extended position and a retracted position;

a plurality of control valves transitionable between a closed position and an open position, the plurality of control valves having at least one extend control valve, at least one retract control valve, and at least one float control valve; and a logic control system communicatively coupled with the plurality of control valves and configured to transition the plurality of control valves between the closed position and the open position;

transitioning, by the logic control system, the multi-mode hydraulic workover unit from one operating mode to another by transitioning the one or more of the plurality of control valves between the open and close positions.

19. The method of claim 18, wherein transitioning the multi-mode hydraulic workover unit from one operating mode to another includes transitioning from a park mode wherein each of the plurality of control valves is closed to a low speed mode wherein the at least one extend control valve and the at least one retract control valve are transitioned to open.

20. The method of claim 18, wherein transitioning the multi-mode hydraulic workover unit from one operating mode to another includes transitioning to a high speed mode wherein the at least one extend control valve and the at least one retract control valve are transitioned to open for one set of hydraulic cylinders and the at least one extend control valve and the at least one retract control valve are closed for the other set of hydraulic cylinders.

21. The method of claim 18, wherein transitioning the multi-mode hydraulic workover unit from one operating mode to another includes engaging a regeneration mode wherein at least one regeneration control valve is open during extension of at least one of the set of hydraulic cylinders.

22. The method of claim 18, wherein the at least two sets of hydraulic cylinders are configured to dispose pipe into a wellbore.

* * * * *